United States Patent [19]

Spiess et al.

[11] Patent Number: 4,960,933

[45] Date of Patent: Oct. 2, 1990

[54] BORON TRIS-(DIALKYL-DITHIOCARBAMATES) AND A PROCESS FOR THEIR PREPARATION

[75] Inventors: Wolfram Spiess; Rolf Himmelreich, both of Grünstadt, Fed. Rep. of Germany

[73] Assignee: C. F. Spiess & Sohn GmbH & Co., Kleinkarlbach, Fed. Rep. of Germany

[21] Appl. No.: 399,675

[22] Filed: Aug. 28, 1989

Related U.S. Application Data

[62] Division of Ser. No. 186,337, Apr. 26, 1988.

[30] Foreign Application Priority Data

Apr. 29, 1987 [DE] Fed. Rep. of Germany ..... 3714260

[51] Int. Cl.[5] ..... C07F 5/02

[52] U.S. Cl. ..... 562/882

[58] Field of Search ..... 562/882

[56] References Cited

U.S. PATENT DOCUMENTS 2,862,952 12/1958 Groszos ..... 260/545 R 2,941,000 6/1960 May et al. ..... 260/545 R

OTHER PUBLICATIONS

Cotton et al., "Advanced Inorganic Chemistry", Interscience Publishers, New York, N.Y., 1966, pp. 262–263 & 266–270.

Lalia-Kantouri et al., C.A., 88, 181,644y (1978).

Lalia-Kantouri et al., C.A., 84, 11648c (1976).

*Primary Examiner*—Nicky Chan

*Attorney, Agent, or Firm*—Sprung Horn Kramer & Woods

[57] ABSTRACT

Boron tris-(dialkyl-dithiocarbamate) of the general formula (I)

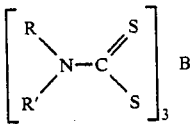

wherein R and R′ represent the same or different branched-or straight-chain saturated or unsaturated alkyl radicals having from 1 to 16 carbon atoms and a process for preparing the same, comprising reacting 3 moles of an alkali dialkyl-dithiocarbamate of the general formula

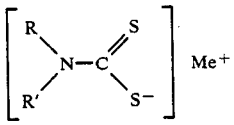

wherein R and R′ are as defined in claim 1 and $Me^+$ represents $NA+$, $K+$ or $NH_4+$ with one mole boron tribromide, boron trichloride or boron trifluoride in an inert medium, separating the so-formed alkali metal or ammonium halide and isolating the boron tris-(dialkyl-dithiocarbamate). The new boron dithiocarbamates are suitable as additives for hydraulic oils or permanent gear lubricant oils.

11 Claims, No Drawings

BORON TRIS-(DIALKYL-DITHIOCARBAMATES) AND A PROCESS FOR THEIR PREPARATION

This is a division of application Ser. No. 186,337, filed Apr. 26, 1988, now U.S. Pat. No. 4,879,071.

This application relates to novel boron dithiocarbamates. A large number of metal dithiocarbamates has been described, see Elsevier Monographs "The Dithiocarbamates and related Compounds" by Thorn and Ludwig (1962), Table I, pages 12 to 34.

The present invention provides novel boron tri-(dialkyldithiocarbamates) of the general formula

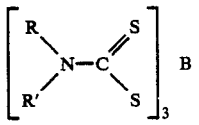

(I)

wherein R and R' are the same or different branched-or straight-chain saturated or unsaturated hydrocarbon groups having from 1 to 16 carbon atoms. These hydrocarbon groups may also be cycloalkyl groups, such as cyclohexyl.

Furthermore, the invention also provides novel processes for preparing the boron dithiocarbamates of the general formula I. The preparation of these compounds takes place according to the following equations:

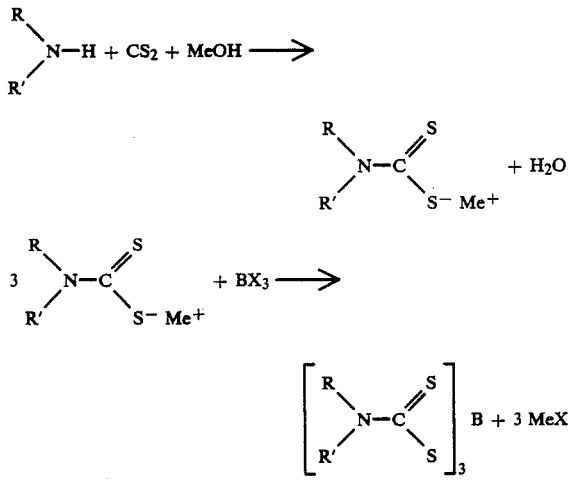

In these equations, R and R' are as defined above, X represents bromine, chlorine or fluorine and Me is an alkali metal or ammonium ion, preferably the sodium ion.

The preparation of the alkali dialkyl-dithiocarbamates is basically known. For preparing the sodium dialkyl-dithiocarbamates, one usually proceeds as follows:

A 50% sodium hydroxide solution is poured into methanol. A secondary amine is added thereto and carbon disulfide is added drop by drop. All reaction components are used in stoichiometric amounts. Carbon disulfide may also be used in excess amounts. The mixture is mechanically stirred for 1 to 3 hours. The formation of the sodium dithiocarbamate is then terminated.

This solution can directly be used as starting material for the subsequent preparation of boron tris-(dialkyl-dithiocarbamates) and the reaction can be continued in the same reaction vessel if one subsequently adds thereto, dropwise, 1 mole of a solution of the boron trifluoride-diethyl ether or -methanol complex in diethyl ether per 3 moles of the sodium dithiocarbamate.

Instead of methanol, also other solvents which are miscible with water can be used, for example, ethylene glycol monoalkyl ether, tetrahydrofuran, dioxane, ethanol, propanol or isopropanol. The boron trifluoride complex compounds are not as susceptible to hydrolysis as the free boron halides so that the process may be carried out in aqueous-alcoholic solution; however, the water content in the reaction medium should not exceed 15% by weight.

The reaction is slightly exothermic in the two steps. Additional heating or external cooling is, therefore, usually not necessary. The reaction is conducted at 0 to 90, preferably at 20° to 70° C.

After termination of the reaction with the boron trifluoride complex, the mixture is additionally stirred for some hours. It is then sucked off from the crystallized alkali metal fluoride. The mixture of water and solvent is distilled off from the filtrate. To avoid a temperature in excess of 70° C., residual amounts of solvents are suitably distilled off in vacuo. One obtains faintly yellow to amber colored oils which are preferably filtred again until they are clear.

If one wants to use instead of the boron fluoride-diethylether or -methanol complex, boron tribromide, boron trichloride or boron trifluoride as reaction component, it is necessary to use the corresponding alkali alkyl-dithiocarbamate in an anhydrous condition. The aqueous solution formed at first must be reduced to dryness before the alkali alkyl-dithiocarbamate can be reacted in an anhydrous inert solvent with the boron halide.

Suitable inert solvents for the reaction in the anhydrous medium are aliphatic or aromatic hydrocarbons or lower dialkyl ethers. As to the temperatures to be observed, the same applies here as in a water-containing medium.

The so-called "one pot process" can be applied in both cases, i.e. the preparation of the boron tris-(dialkyl-dithiocarbamate) can take place in the same reaction vessel wherein in the first step the alkali or ammonium dialkyl-dithiocarbamate had been prepared from a suitable secondary amine, carbon disulfide and alkali hydroxide, or according to another process known per se.

The new boron dithiocarbamates of the general formula I are suitable as additives for hydraulic oils or permanent gear lubricant oils.

The preparation of the compounds of the present invention is illustrated by a few examples:

EXAMPLE 1

Boron tris-(di-2-ethylhexyl-dithiocarbamate)

15 kg of a 50% sodium hydroxide solution are poured into 94 liters methanol in a 200 liters glass apparatus with mechanical stirring. 45 kg Di-2-ethylhexyl amine are subsequently added thereto. 15 kg Carbon disulfide are then added, drop by drop, in the course of 30 minutes. The mixture is thereafter stirred for another 2 hours. A solution of 7.5 kg boron trifluoride-diethyl ether complex (a 50%-solution) in 19 liters ether is added thereto dropwise over a period of 90 minutes. The mixture is stirred for another 3 hours, closed and allowed to stay overnight. It is sucked off the next morning from precipitated sodium fluoride through an earthenware suction filter. The mixture of methanol, water and ether is distilled off from the filtrate, at the end in vacuo, whereby it is not heated above 70° C. After cooling, the oil is again sucked off. 46.6 kg of a clear amber colored oil are obtained which has a purity of 100.1%, based on the total amount of nitrogen. The yield was 77.62% of the calculated amount, based on $BF_3$.

EXAMPLE 2

Boron tris-(di-2-ethylhexyl-dithiocarbamate)

24 g of a 50% sodium hydroxide solution are poured into 250 ml water. 72.3 g Di-2-ethylhexyl amine are added thereto. 20 ml carbon disulfide are added thereto dropwise over a period of 20 minutes with mechanical stirring. The mixture is stirred for another 30 minutes. It is then reduced to dryness in vacuo in a rotary evaporator at a bath temperature of 50° C. The dry powder is dissolved in 200 ml di-isopropylether, which was dried over molecular sieve. A solution of 25 g boron tribromide in 100 ml di-isopropyl ether, which was likewise dried over molecular sieve, is added thereto dropwise over a period of one hour with mechanical stirring. The mixture is stirred for another 3 hours and is allowed to stay overnight. It is sucked off from sodium bromide under weak partial vacuum. The di-isopropyl ether is distilled off. The residue is dried in vacuo at 70° C. One obtains 44 g of a yellowish oil having a purity of 96.9%, based on nitrogen.

EXAMPLE 3

Boron tris-(di-2-ethylhexyl dithiocarbamate)

40 g sodium hydroxide granules are dissolved in 350 ml methanol. 241 g di-2-ethylhexyl amine are added thereto. 64 ml Carbon disulfide are added thereto with mechanical stirring within 20 minutes. The mixture is further stirred for another 2 hours. Thereafter, 171 g boron trifluoride-methanol complex (14% $BF_3$) are added thereto dropwise over a period of one hour. The mixture is further stirred for another 2 to 3 hours, closed and allowed to stay overnight. It is then sucked off from sodium fluoride. The solvent is distilled off and the residue is dried in vacuo. Finally, it is sucked off again. One obtains 223 g of a yellowish oil having a purity of 97.3%, based on nitrogen. The yield was 69.7% of the calculated amount, based on $BF_3$.

EXAMPLE 4

Boron tris-(diamyl-dithiocarbamate)

150 g of a 50% sodium hydroxide solution are poured into 940 ml methanol. 293 g diamyl amine are added thereto. Thereafter, 120 ml carbon disulfide are added dropwise with mechanical stirring over a period of 30 minutes. The mixture is further stirred for another 2 hours. 75 g Boron trifluoride-diethyl ether complex are poured into 190 ml ether. This solution is added dropwise within 90 minutes to the solution of the sodium dithiocarbamate. The mixture is further stirred for another 3 hours. It is then sucked off from sodium fluoride. The solvent mixture is distilled off from the filtrate. The residue is dried in vacuum in a water bath at 70° C. for one hour. It is thereafter sucked off again. One obtains 325 g of a yellowish colored oil having a purity of 98.45%, based on nitrogen. The yield amounts to 83% of the calculated amount, based on boron trifluoride.

EXAMPLE 5

Boron tris-(ditridecyl-dithiocarbamate)

80 g of a 50%-sodium hydroxide solution is poured into 500 ml methanol. 381 g Ditridecyl amine are added thereto. Thereafter, 64 ml carbon disulfide are added dropwise at reflux with mechanical stirring within 30 minutes. The mixture is further stirred for another 2 hours. A solution of 45 ml boron trifluoride-ethyl ether complex is subsequently added thereto, drop by drop, within 1 hour. The mixture is further stirred for another 3 hours. It is closed and allowed to stay overnight. It is then sucked off from sodium fluoride. The solvent mixture is distilled off from the filtrate. The residue is dried in vacuo in a rotary evaporator at a bath temperature of 70° C. The so-formed oil is again sucked off after cooling. One obtains 393 g of an amber colored viscous oil having a content of 98.7%. The yield amounts to 85.4% of the calculated amount.

It will be appreciated that the instant specification and claims are set forth by way of illustration and not limitation, and that various modifications and changes may be made without departing from the spirit and scope of the present invention.

What is claimed is:

1. A process for preparing a boron tris-(dialkyl-dithiocarbamate) of the formula

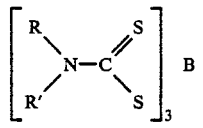

wherein R and R′ represent the same or different branched- or straight-chain saturated or unsaturated hydrocarbon groups having from 1 to 16 carbon atoms, comprising reacting 3 moles of an alkali dialkyl-dithiocarbamate of the formula

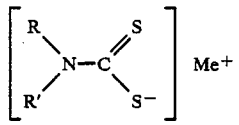

wherein $Me^+$ represents $Na^+$, $K^+$ or $NH_4^+$, with one mole of boron tribromide, boron trichloride or boron trifluoride, separating the so-formed alkali metal or ammonium halide and isolating the boron tris-(dialkyl-dithiocarbamate).

2. A process according to claim 1, wherein the reaction is conducted at a temperature from about 0° to 90° C.

3. A process according to claim 1, wherein the reaction is conducted at a temperature from about 20° to 70° C.

4. A process according to claim 1, wherein the reaction is effected in an inert medium.

5. A process according to claim 4, wherein the inert medium comprises ethers or aliphatic or aromatic hydrocarbons.

6. A process according to claim 1, wherein the boron trifluoride is in the form of a complex with diethyl ether or with methanol and the reaction is effected in an aqueous medium.

7. A process according to claim 6, wherein the aqueous medium is aqueous methanol, ethanol, propanol, isopropanol, ethylene glycol monoalkyl ether, tetrahydrofuran or dioxane.

8. A process according to claim 6, wherein the water content of the aqueous medium does not amount to more than 15% by weight.

9. A process according to claim 1, wherein the product is boron tris-(di-2-ethylhexyl-dithiocarbamate).

10. A process according to claim 1, wherein the product is boron tris-(diamyl-dithiocarbamate).

11. A process according to claim 1, wherein the product is boron tris-(ditridecyl-dithiocarbamate).

* * * * *